United States Patent [19]

Sauerwein et al.

[11] 4,256,036

[45] Mar. 17, 1981

[54] PRINT WHEEL SETTING AND CONTROL MEANS IN PRINTING MACHINES

[75] Inventors: Lewis E. Sauerwein, Crystal Lake; Richard L. Gross, Fox River Grove, both of Ill.

[73] Assignee: AM International, Inc., Los Angeles, Calif.

[21] Appl. No.: 74,039

[22] Filed: Sep. 10, 1979

[51] Int. Cl.[3] ..... B41F 3/04

[52] U.S. Cl. ..... 101/45; 101/56

[58] Field of Search ..... 101/45, 56, 269–274

[56] References Cited

U.S. PATENT DOCUMENTS

| | | | |
|---|---|---|---|
| 3,322,062 | 5/1967 | Maul | 101/45 |
| 3,405,634 | 10/1968 | Maul et al. | 101/45 |
| 3,623,426 | 11/1971 | Gruss | 101/45 |
| 3,776,130 | 12/1973 | Tamiya | 101/45 |
| 3,826,190 | 7/1974 | Zofchak | 101/45 |
| 3,865,026 | 2/1975 | Trout | 101/45 |
| 3,881,411 | 5/1975 | Araki et al. | 101/45 |
| 3,983,802 | 10/1976 | Thomson et al. | 101/45 |
| 4,056,054 | 11/1977 | Feldman | 101/45 |

*Primary Examiner*—Edward M. Coven
*Attorney, Agent, or Firm*—Robert S. Hulse; A. W. Karambelas; R. C. Curfiss

[57] ABSTRACT

A printing machine is provided for imprinting forms with fixed data from embossed printing plates and variable data from manually settable print wheels by moving a roller platen from a start position across the printing elements and the form to an actuated position to perform a printing operation and back to the start position to complete a printing cycle. The print wheels are selectively positionable by keyset levers movable from a zero position to a selected printing position for rotating each of the print wheels to a desired peripheral setting. Reset means is provided for restoring each of the keyset levers from the selected printing position to the zero position in response to movement of the roller platen through a printing operation, and lock-out means is provided to inhibit movement of the roller platen through a printing operation following a printing cycle. The roller platen is unlocked for movement in response to movement of at least one of the keyset levers from the zero position to a new setting.

7 Claims, 8 Drawing Figures

PRINT WHEEL SETTING AND CONTROL MEANS IN PRINTING MACHINES

BACKGROUND OF THE INVENTION

The present invention relates to a printing machine and, more particularly, to a data recorder for imprinting forms with fixed data from embossed printing plates and variable data from selectively settable print wheels. Such data recorders are commonly used to record printed sales transactions from embossed credit cards.

In recent years, credit transactions have come into wide-spread usage in many different fields and a variety of data recorders have been provided for use in these applications. One such data recorder is shown in U.S. Pat. No. 3,138,091 and is adapted for imprinting from embossed printing plates onto carbon interleaved forms utilizing a dry roller platen, or it may be provided with an ink impregnated roller platen for imprinting single-part forms. The data recorder also includes variable data print wheels which are selectively settable by keyset levers. This type of data recorder provides for recording the name, address and account number of the customer from the printing plate, and the variable data such as the amount of the sale from the selectively settable print wheels.

Another data recorder is disclosed in U.S. Pat. No. 3,405,634 and comprises variable data print wheels and a blocking means to prevent movement of the platen through a printing operation in all instances wherein at least one of the print wheels has not been reset following a preceeding printing operation. The blocking means prevents inadvertent operation due to failure of the machine operator to reset the print wheels to a new setting prior to each printing operation, since the machine requires that at least one of the print wheels be reset before an impression on the form can be made.

Still another data recorder is shown in U.S. Pat. No. 3,983,802 and provides means for restoring the variable data print wheels to a zero position in response to movement of the roller platen through a printing operation, and means to inhibit further operation by preventing the closing of a pivotal head assembly unless at least one of the print wheels has been reset to a non-zero value.

Still other data recorders which provide for restoring the keyset levers and corresponding print wheels to a zero position following a printing operation, and blocking means for inhibiting movement of the platen if at least one of the keyset levers is not moved from the zero position to a new setting are shown, for example, in U.S. Pat. Nos. 3,826,190 and 3,865,026.

SUMMARY OF THE INVENTION

The present invention provides a data recorder for imprinting forms with fixed data from embossed credit cards and variable data from manually settable print wheels by moving a roller platen from a start position across the printing elements to an actuated position and back to the start position.

The print wheels are selectively settable by keyset levers movable from a zero position to a selected printing position for rotating each corresponding print wheel to a desired setting. Reset means is provided for restoring the keyset levers from the printing position to the zero position during movement of the roller platen through a subsequent printing operation following a complete printing cycle to prevent inadvertent operation due to failure of the machine operator to reset the print wheels to a new setting prior to each printing operation. The lock-out means is actuable from an active position preventing movement of the roller platen to an inactive position permitting movement of the roller platen in response to moving at least one of the keyset levers from the zero position to a selected printing position. The lock-out means is actuable from the inactive to the active position in response to the reset means restoring the keyset levers to the zero position.

It is an object of the present invention to provide a data recorder comprising print wheels selectively settable from a zero position to a printing position under control of keyset levers, and a reset means for restoring the keyset levers from the printing position to the zero position in response to movement of the roller platen through a printing operation.

Another object is to provide a lock-out means to inhibit movement of the roller platen through a subsequent printing operation following a preceeding printing cycle in response to the keyset levers being restored to the zero position. Movement of at least one of the keyset levers from the zero position to a new setting releases the lock-out means to permit movement of the roller platen through a printing operation.

Features of the invention are to provide a compact, low-cost data recorder which is reliable in operation and eliminates the possibility of the machine operator recording a new sales transaction using the information set into the print wheels for a previous transaction.

The present invention will become more fully understood from the detailed description given hereinbelow in conjunction with the accompanying drawing, which are given by way of illustration only and thus are not limitative of the present invention.

IN THE DRAWING

DESCRIPTION OF THE PREFERRED EMBODIMENT

Figure 1:
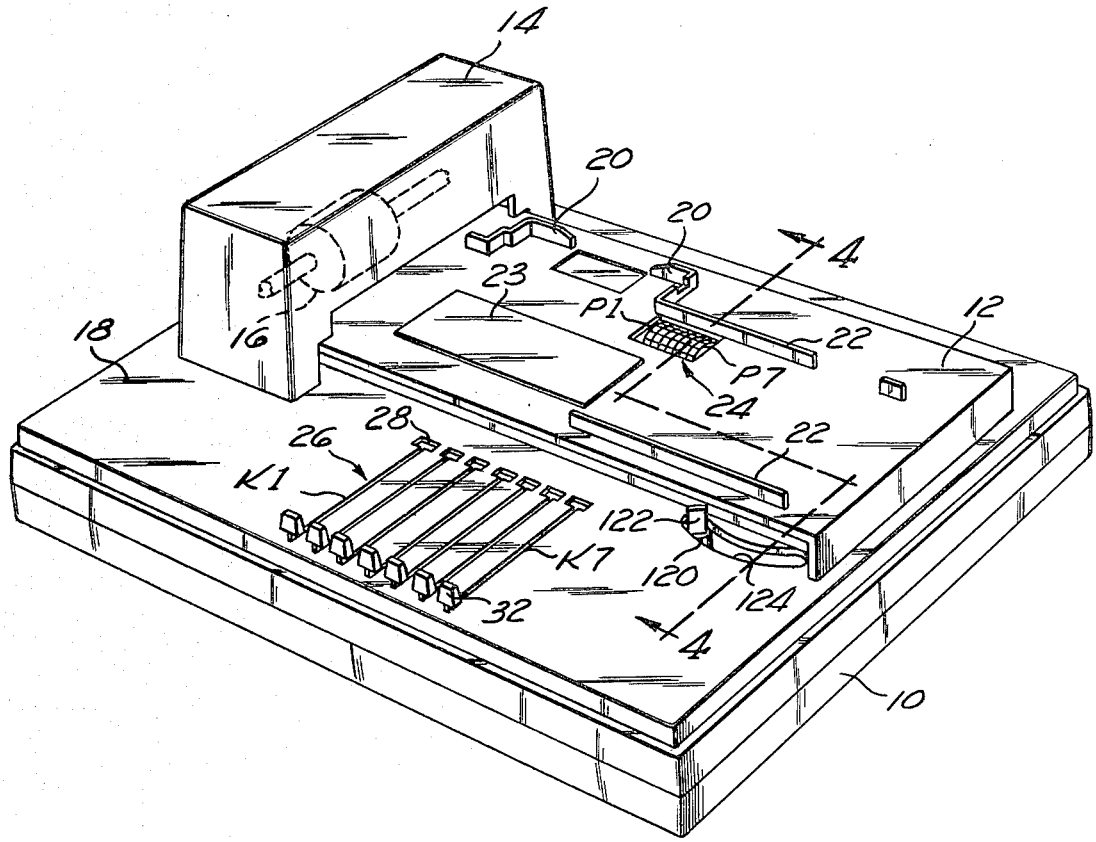
FIG. 1 is top, right front perspective of a data recorder in accordance with the present invention.
Figure 6:
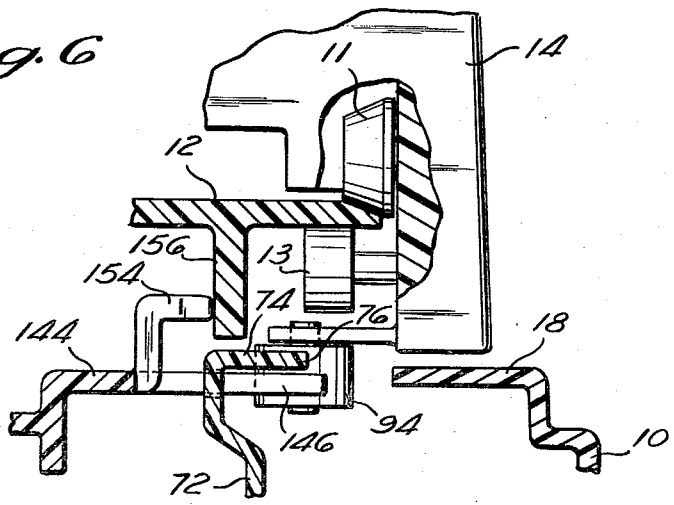
FIG. 6 is a section taken substantially along the line 6—6 of FIG. 2.

With reference to FIG. 1, the data recorder comprises a base 10, a bed 12, a platen carriage 14 and a roller platen 16 rotatably supported on the platen carriage 14. The platen carriage 14 is movable along the bed 12 from a start position shown in FIG. 1 to an actuated position at the other end of the bed 12 to perform a printing operation and back to the start position to complete a printing cycle. The platen carriage 14 is guided in its movement along the bed 12 by rollers 11 and 13 as shown in FIG. 6. The base 10 is also provided with a top cover 18 and side walls substantially enclosing the base 10.

The bed 12 is provided with retainers 20 for locating an embossed credit card (not shown), retainers 22 for locating a form (not shown) to be imprinted positioned in overlying relation with the credit card, a station plate 23 and a series of variable data print wheels indicated generally at 24 and designated individually as P1 to P7 from left to right in FIG. 1. Positioning means is provided comprising a bank of keyset levers indicated generally at 26 and designated individually as K1 to K7 from left to right in FIG. 1, with one keyset lever for selectively positioning each of the corresponding print wheels P1–P7. Indexing means, not shown in the drawing, viewable through a window 28 associated with each of the keyset levers K1–K7, provides the machine operator with a visual indication of the setting of the print wheels 24 for a printing operation.

Because all of the keyset levers 26 are identical in construction and operation, and all of the print wheels 24 are identical in construction and operation, only the keyset lever K7 and the corresponding print wheel P7 and their related mechanisms will be described in detail.

Figure 3:
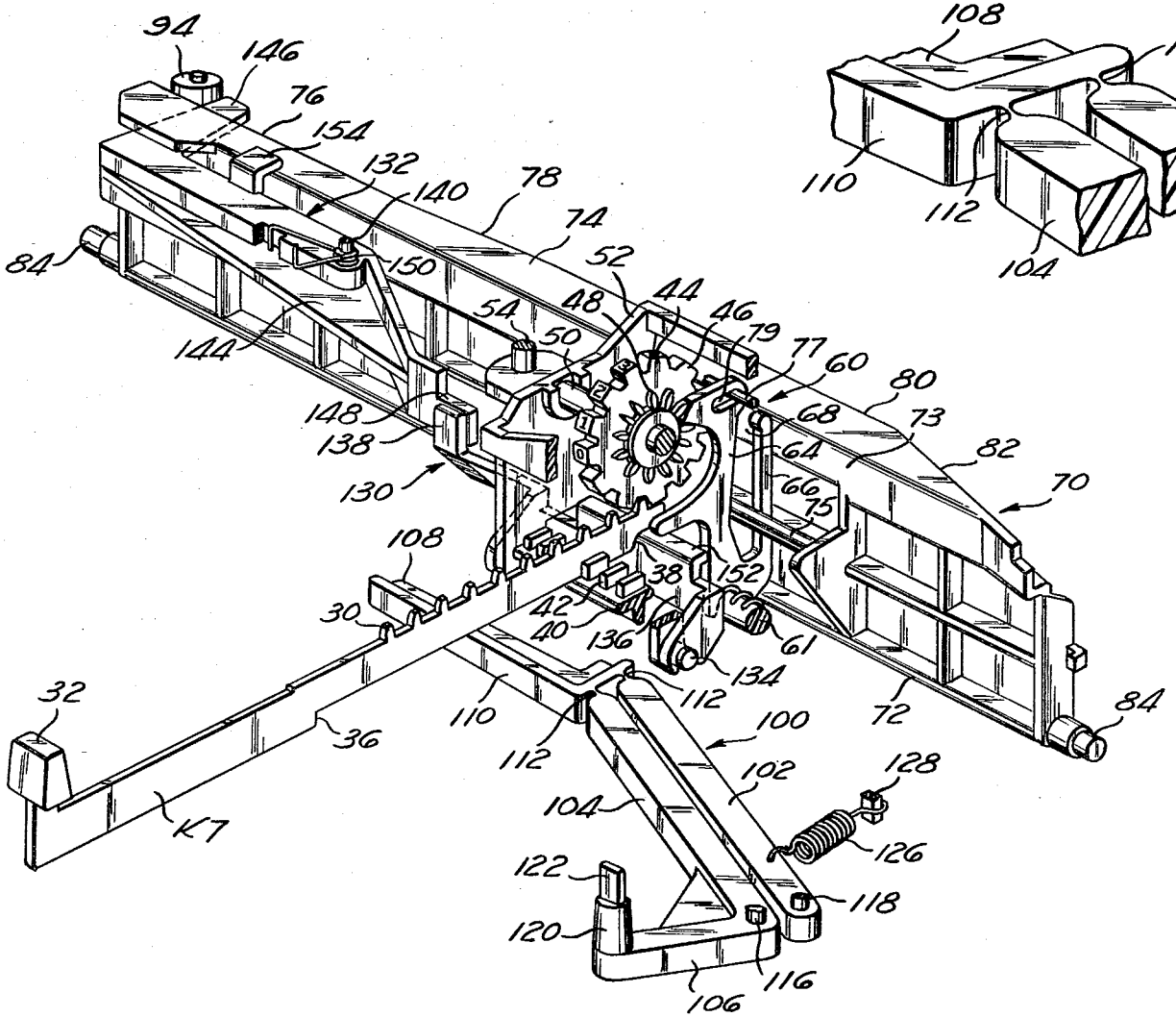
FIG. 3 is a perspective of the reset means, the lock-out means, a control cam, and a keyset lever and its corresponding print wheel and detent pawl.
Figure 4:
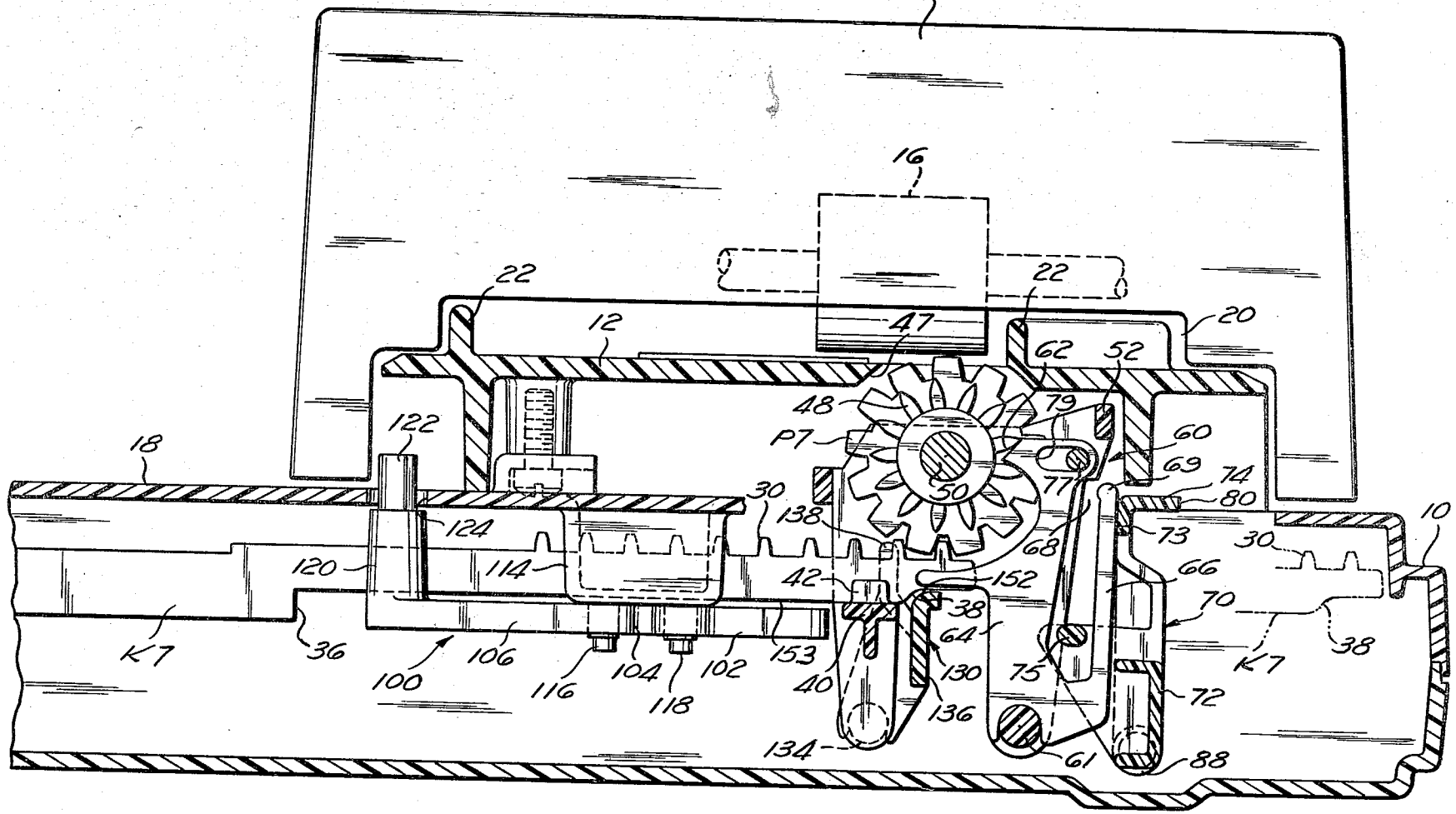
FIG. 4 is a section, on an enlarged scale, taken substantially along the line 4—4 of FIG. 1.

As best shown in FIGS. 3 and 4, the keyset lever K7 comprises rack teeth 30, a finger grip 32 for manually moving the lever between the zero position shown in full lines and the digit "9" position shown in phantom in FIG. 4, a notch 36 and a camming surface 38. The lever K7 is supported on a ledge 40 of a housing 52 and is positioned between adjacent rails 42 on the ledge 40 for guiding the lever in its movement for rotating the print wheel P7 between a zero position and a desired printing position.

Figure 2:
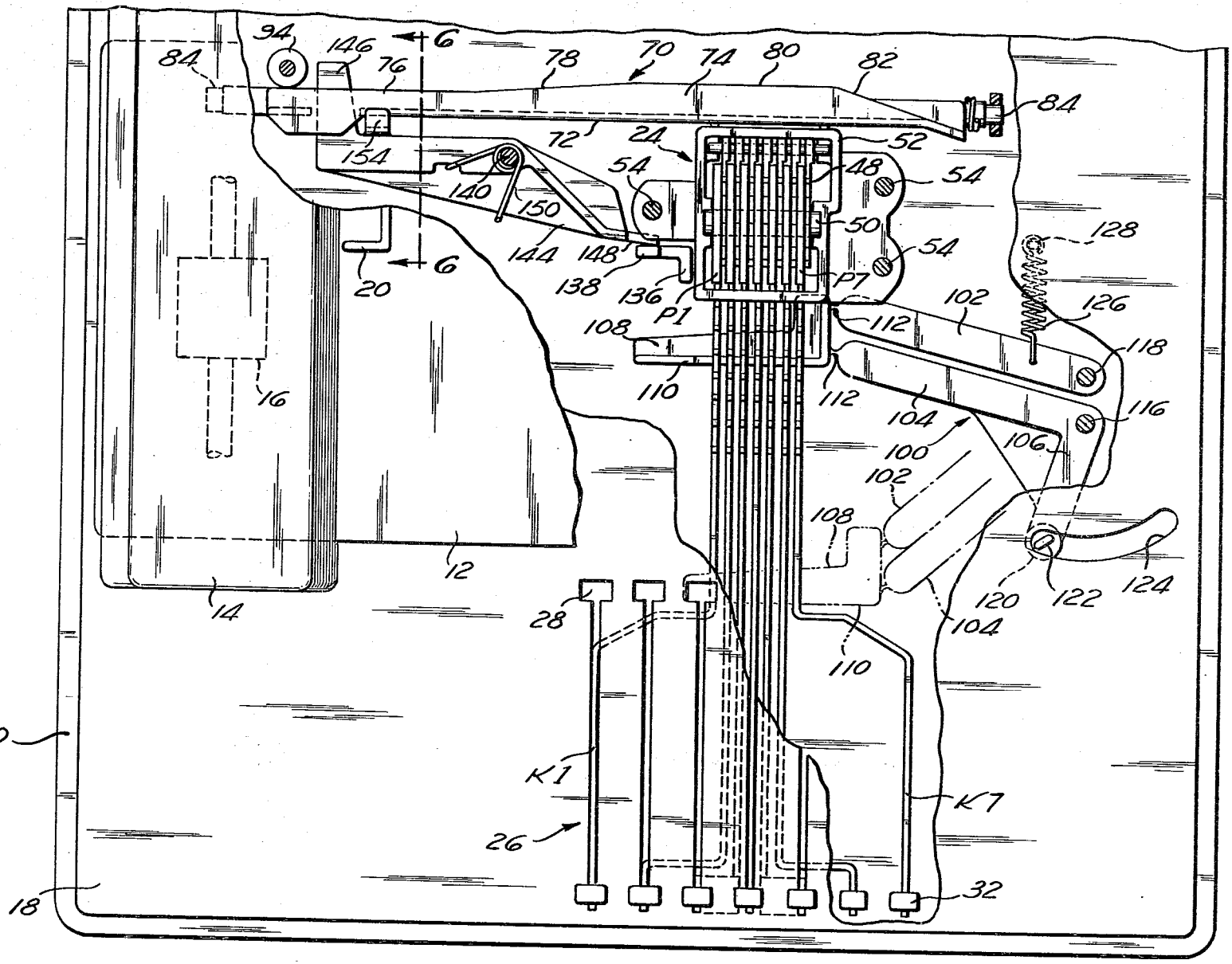
FIG. 2 is a plan view, partially broken away, illustrating the print wheel reset means and the roller platen lock-out means.
Figure 5:
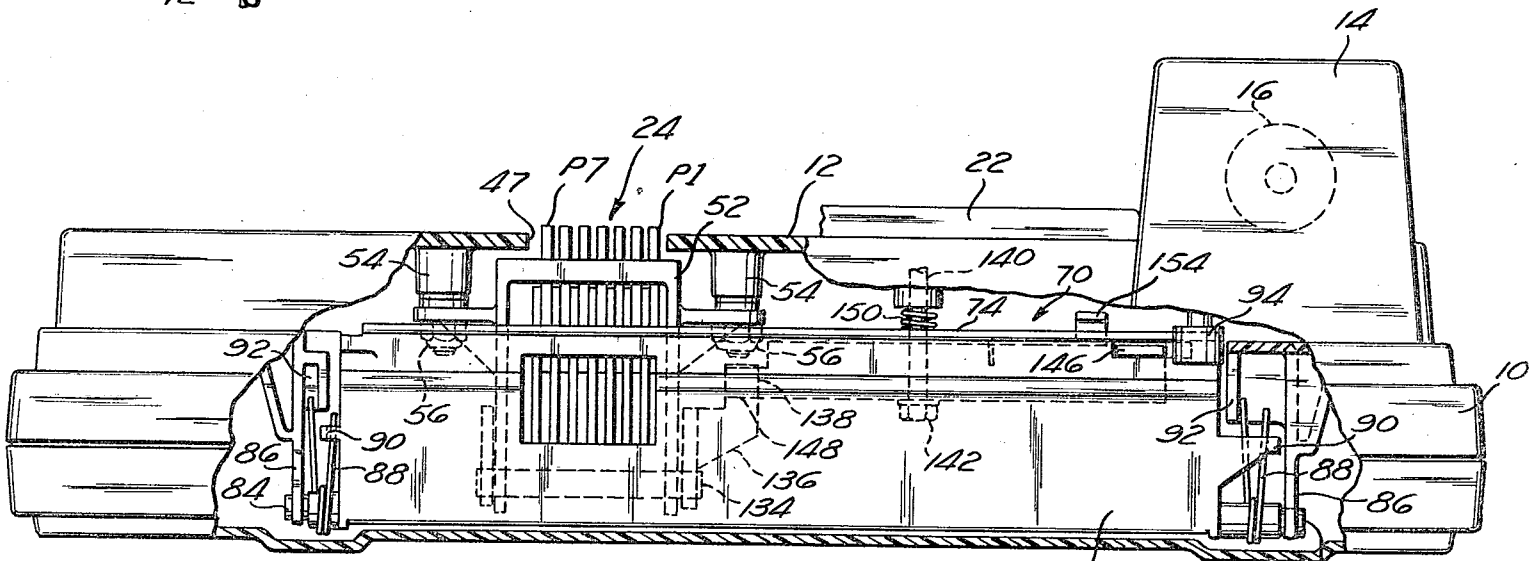
FIG. 5 is a rear elevation of the data recorder with a portion of the cover partially broken away.

The print wheel P7 comprises a series of print faces 44 ten of which are each provided with one of the digits 0–9 in sequential order. While the print wheel could be provided with only ten faces 44, to accomodate the digits 0–9, in the arrangement shown in the drawing the print wheel provides three additional blank faces which could be utilized for imprinting a dollar sign, decimal point, etc. The print wheel P7 is in the form of a gear wheel in which the type faces 44 are provided on teeth 46 and the teeth are evenly spaced around the periphery. The print wheels 24 project through an opening 47 in the bed 12 to a printing level for contact by the roller platen 16 as shown in FIGS. 1, 4 and 5. A pinion 48 is secured to one face of the print wheel P7 and the print wheel is rotatably supported on a shaft 50 mounted in the housing 52, as shown in FIGS. 2 and 3. The housing 52, as shown in FIGS. 2 and 5, is secured to the underside of the bed 12 at 54 with fasteners 56. As best shown in FIGS. 3 and 4, the rack teeth 30 mesh with the teeth 46 of the print wheel P7 to impart rotation to the print wheel in either direction, depending upon the direction of movement of the lever K7.

A detent pawl indicated generally at 60 is associated with each of the print wheels 24 and comprises a nose 62, a body 64 and a resilient member 66 spaced from the body 64 by a gap 68, as shown in FIGS. 3 and 4. The detent pawl 60 is constructed of a material such as plastic to cause the resilient member 66 to function as a spring integral with the detent pawl 60. The detent pawl is pivotally supported on a pivot rod 61 in the housing 52 and is actuable through discrete operating states during a printing cycle, under control of a control cam indicated generally at 70, as will be described hereinafter.

The control cam 70 is shown in FIGS. 2, 3, 5 and 7 and comprises an elongate member 72 having a camming surface 74 including cam profiles shown at 76, 78, 80 and 82. Each end of the member 72 is provided with a pin 84 for pivotally supporting the control cam 70 in a pair of brackets 86 provided in the base 10.

Figure 7:
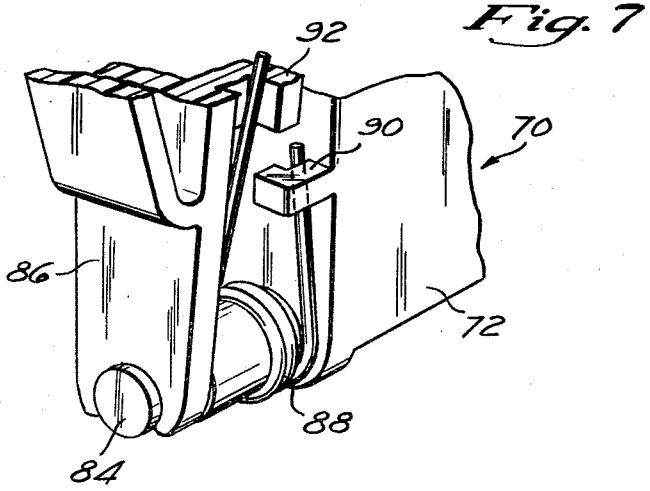
FIG. 7 is a fragmentary perspective of one end of the control cam.

The control cam 70 is biased in a clockwise direction as viewed in FIG. 4 by a torsion spring 88 provided at each end of the control cam. The torsion spring 88 is supported on the pin 84 and is retained by lugs 90 and 92 provided on the member 72 and the bracket 86 respectively, as shown in FIGS. 5 and 7. The control cam 70 is free to pivot about the axial center of the pins 84 which extend longitudinally and parallel with the bed 12. As shown in FIGS. 2, 3, 5 and 6, a cam follower roller 94 is mounted on the platen carriage 14 at a position to coact with the cam profiles 76, 78, 80 and 82 of the control cam 70. The cam follower roller 94 is maintained in contact with the cam profiles by the biasing action imparted to the control cam 70 by the torsion springs 88.

With the platen carriage 14 in the start position shown in FIGS. 1 and 2, the cam follower roller 94 acting against the cam profile 76 pivots the control cam 70 slightly in a counter clockwise direction as viewed in FIG. 4 to cause a surface 73 of the control cam to act against the resilient member 66 of the detent pawl 60. This action maintains the nose 62 of the detent pawl in a space between adjacent teeth of the pinion 48 and in contact with the teeth. However, because the resilient member 66 is deflected only slightly, the nose 62 is not in firm engagement with the teeth but affords sufficient pressure to the detent pawl to provide a detenting action for setting the print wheel P7 to a selected printing position without encountering excessive resistance in the rotation of the print wheel.

As the platen carriage 14 is moved along the bed 12 towards the actuated position at the other end of the bed, the cam follower roller 94 acts against the cam profile 78, as shown in FIG. 4. The rise in the cam profile 78 from the cam profile 76 pivots the control cam 70 further in a counter clockwise direction, thereby increasing the deflection of the resilient member 66 being acted upon by the surface 73 of the control cam 70, pivoting the detent pawl 60 in a counter clockwise direction and urging the nose 62 into firm engagement with the teeth of the pinion 48 to rigidly hold the print wheel P7 against rotation. In this position, with the cam follower roller 94 at the high point of the cam profile 78, the gap 68 is closed and an upper end 69 of the resilient member 66 is in solid contact with the body 64 of the detent pawl 60.

Further movement of the platen carriage 14 towards the actuated position causes the cam follower roller 94 to act against the cam profile 80 which is uniform and in line with the high point of the cam profile 78. The cam follower roller 94 coacting with the cam profile 80 maintains the nose 62 in firm engagement with the teeth of the pinion 48 to prevent movement of the print wheels during a printing operation.

After an impression from the print wheels has been made on a form, further movement of the platen carriage 14 to the actuated position causes the control cam 70 to pivot in a clock-wise direction, as viewed in FIG. 4, due to the fall of the cam profile 82 from the cam profile 80. As the control cam 70 is pivoted, the pressure on the resilient member 66 is relieved, the detent pawl 60 is pivoted in a clockwise direction, the gap 68 is opened and the nose 62 of the detent pawl 60 is withdrawn completely from the teeth of the pinion 48. In this position of the detent pawl 60 there in no inhibition to rotation of the print wheels 24.

The clockwise pivoting of the control cam, as explained above, also imparts clockwise motion to the detent pawl 60 to withdraw the nose 62 from the teeth of the pinion 48. The motion is imparted to the detent pawl 60 by a fixed bail 75 integral with the control cam 70 and positioned in the gap 68 as shown in FIGS. 3 and 4. Thus, as the control cam 70 is pivoted relieving the pressure on the resilient member 66, the bail 75 contacts the resilient member 66 and urges the detent pawl in a clockwise direction about its pivot.

The detent pawl 60 is also guided in its pivotal movement to properly align the nose 62 with the space between adjacent teeth of the pinion 48 by means of a fixed rod 77 mounted in the housing 52. As shown in FIGS. 3 and 4, the rod 77 is positioned in an elongate opening 79 in the detent pawl 60 to thereby maintain the nose 62 in an aligned position for movement into and out of engagement with the teeth of the pinion 48 during pivotal motion of the detent pawl 60.

Figure 8:
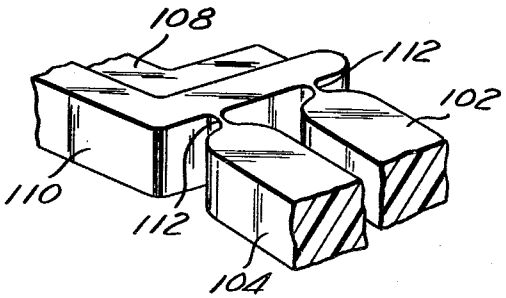
FIG. 8 is a fragmentary perspective of a portion of the reset means.

The reset means is indicated generally at 100 in FIGS. 2, 3 and 4, and comprises a first link 102, a second link 104 having an arm 106 integral therwith, and a third link 108 having a face 110 adapted to coact with the notch 36 of the keyset lever K7 for restoring the lever and the print wheel P7 from a printing position to a zero position as shown in the drawing. Each of the links 102 and 104 is attached to the link 108 by means of a thin web member 112 (FIG. 8) which serves as a hinge in the movement of the link 108 during actuation of the reset means 100. Preferably, the reset means 100 is constructed of plastic or other suitable material such that the web members 112 are sufficiently flexible to function as hinges.

The reset means 100 is mounted on a member 114 depending from the cover 18 for pivotal movement about pivots 116 and 118 as shown in FIGS. 2, 3 and 4. Also, the arm 106 is provided with a boss 120 having an actuator 122 projecting upwardly through an arcuate slot 124 provided in the cover 18. The reset means 100 is positioned sufficiently below the cover 18 to permit pivotal movement of the reset means, between an initial position shown in full lines and a final position shown in phantom in FIG. 2, without interference with the keyset levers 26 except for the coaction of the face 110 of the link 108 with the notches 36 of the keyset levers as described supra. As shown in FIG. 2, a spring 126 connected to the link 102 and lug 128 in the base 10 biases the reset means 100 in a clockwise direction to the initial position.

The pivotal motion of the reset means 100 provides for the face 110 of the link 108 to remain perpendicular to the path of travel of the keyset levers 26 throughout the travel of the reset means from the initial to the final position. This is achieved by designing the links 102 and 104 of equal length and by positioning the pivots 116 and 118 on a line extending parallel with the path of travel of the keyset levers 26. Thus, pivotal movement of the reset means 100 from the initial to the final position causes movement of the face 110 of the link 108 perpendicularly to the path of travel of the keyset levers 26.

As the platen carriage 14 approaches the actuated position it strikes the actuator 122 such that further movement of the platen carriage to the actuated position imparts counter clockwise pivotal motion to the reset means 100 against the bias of the spring 126, as shown in FIG. 2. As the reset means is pivoted, the face 110 of the link 108 comes into contact engagement with the notches 36, which are positioned in the path of sweep of the face 110, and pushes the keyset levers 26 from the printing to the zero position. The zero position of keyset levers is coincident with the positioning of the reset means 100 in its final position and the positioning of the platen carriage 14 in its actuated position. Movement of the platen carriage 14 back to the start position and away from the actuator 122 restores the reset means 100 from the final to the initial position under the influence of the spring 126.

It will be appreciated, the energy for actuating the reset means 100 and restoring the keyset levers 26 to the zero position is provided by the machine operator, in response to movement of the platen carriage through a printing operation, and there is no dependence on spring means or the like to provide the energy required. Hence, because energy provided by spring means may change with age and usage in service, the non-dependency of spring means affords substantially greater reliability in the operation of the reset means 100.

The lock-out means comprises a locking pawl indicated generally at 130 and a locking lever indicated generally at 132, in FIGS. 2, 3, 4 and 6, to inhibit a printing operation if all of the keyset levers 26 are in the zero position.

With reference to FIGS. 3, 4 and 5, the locking pawl 130 is pivotally supported on a rod 134 mounted in the housing 52, and comprises a body 136 and an actuator 138. The locking lever 132 is pivotally mounted on a pin 140 (FIGS. 2 and 4) secured in the base 10 by a fastener 142, and comprises a body 144, a blocking element 146 and a flange 148 adapted to coact with the actuator 138. As shown in FIG. 2, the locking lever 132 also includes a torsion spring 150 supported on the pin 140 for biasing the locking lever 132 in a clockwise direction to an active position thereby moving the blocking element 146 into the path of movement of the cam follower roller 94 to inhibit movement of the platen carriage 14 through a printing operation.

As best shown in FIG. 4, as the lever K7 is moved from the zero position to rotate the print wheel P7 in a counter clockwise direction to a selected printing position, the camming surface 38 of the keyset lever contacts a curved surface 152 of the body 136 of the locking pawl 130 and imparts pivotal movement to the locking pawl in a clockwise direction from a first position. Continued movement of the lever K7 causes further pivotal motion of the locking pawl 130 to a second position in response to the transition of the contact between the curved surface 152 and the camming surface 38 to progress to a lower edge 153 of the lever K7.

With reference to FIGS. 2, 3 and 4, as the locking pawl 130 is pivoted in a clockwise direction the actuator 138 acts against the flange 148 of the locking lever 132 and pivots the locking lever to an inactive position in a counter clockwise direction as viewed in FIG. 2, about the pin 140 and against the bias of the torsion spring 150. This pivoting motion of the locking lever 132 to the inactive position withdraws the blocking element 146 out of the path of travel of the cam follower roller 94 to permit movement of the platen carriage 14 through a printing operation. Thus, the locking lever 132 is in its active position to block movement of the platen carriage 14 when all of the keyset levers 26 are in the zero position and movement of any one of the keyset levers from the zero position pivots the locking pawl 130, which in turn pivots the locking lever 132 to the inactive position, to move the blocking element 146 out of the path of the cam follower roller 94 to permit a printing operation.

The locking lever 132 is pivoted to the active position by the torsion spring 150 in response to the reset means 100 withdrawing the keyset levers from engagement with the locking pawl 130 as the levers are restored to the zero position. Also the movement of the locking lever 132 to the active position causes the flange 148 to act against the actuator 138 to restore the locking pawl 130 from the second to the first position. As the platen carriage 14 is returned from the actuated to the start position, the cam follower roller 94 strikes the blocking element 146. Since the locking lever 132 is not prevented from pivoting in a counter clockwise direction as viewed in FIG. 2, as the cam follower roller 94 strikes the blocking element 146 the locking lever 132 is pivoted against the bias of the torsion spring 150. After the cam follower roller 94 has passed the blocking element 146, the torsion spring 150 restores the locking lever 132 to the active position.

To control the amount of pivotal movement of the locking lever 132 in a clockwise direction as viewed in FIG. 2, and thereby properly position the blocking element 146 in the path of the cam follower roller 94, the locking lever 132 is provided with a stop means 154. As shown in FIGS, 2, 3, 5 and 6, the stop means 154 abuts a rib 156 provided on the bed 12 to prevent further pivoting motion of the locking lever 132 by the torsion spring 150.

In the overall operation of the data recorder, with the platen carriage 14 in the start position at the left end of the bed as shown in FIGS. 1, 2 and 5, the machine operator moves the desired keyset levers from the zero position to position the corresponding print wheels to a selected printing position.

Movement of any one of the keyset levers from the zero position imparts pivotal motion to the locking pawl 130 which, through the actuator 138 acting against the flange 148, pivots the locking lever 132 to the inactive position and moves the blocking element 146 out of the path of the cam follower roller 94. This allows for movement of the platen carriage from the start to the actuated position to perform a printing operation.

During movement of the platen carriage towards the actuated position, the cam follower roller coacts with the cam profiles 76, 78 and 80 to move the nose 62 of each of the detent pawls 60 into engagement with each of the pinions 48 for rigidly holding the print wheels against movement during a printing operation. Following imprinting of the form, further movement of the platen carriage towards the actuated position results in the cam follower roller coacting with the cam profile 82 thereby completely withdrawing the detent pawls from engagement with the pinions and permitting uninhibited movement of the keyset levers and their respective print wheels to the zero position by the reset means.

As the platen carriage is moved to the actuated position it strikes the actuator 122 and pivots the reset means 100 from the initial to the final position. The face 110 of the link 108 of the reset means acts against the notches 36 to restore the keyset levers from the printing to the zero position. Also, at this time, the return of the keyset levers to the zero position imparts pivotal movement to the locking pawl and the locking lever to restore the blocking element into the path of the cam follower roller.

As the platen carriage is returned from the actuated to the start position to complete a printing cycle, the detent pawls are again moved into engagement with the pinions to provide for smart alignment of the print wheels with the keyset levers. Further movement of the platen carriage to the start position causes the cam follower roller to act against the blocking element and pivot the locking lever to permit passage of the cam follower roller. Once the cam follower roller passes the blocking element the torsion spring 150 restores the locking lever to its active position and the platen carriage is locked against movement until at least one of the keyset levers is moved from the zero position. With the platen carriage in the start position, the detent pawls are again positioned for setting of the print wheels and the machine is in readiness for a further printing cycle.

From the foregoing, it will be appreciated that the present invention provides a data recorder incorporating a novel arrangement to prevent inadvertent operation by the machine operator in those instances where the print wheels have not been reset for a new printing operation. The arrangement of the control cam for operating the detent pawls into and out of holding engagement with the print wheels, and simultaneously actuating the reset means for restoring the keyset levers to the zero position during a printing operation, provides for reliable operation because the energy to effect these actions is dependent on the machine operator and not spring means or the like which can change with usage and age.

Further, the lock-out means provides a simple but reliable arrangement for positively blocking movement of the platen carriage following a printing cycle, including means to readily unlock the platen carriage for movement in response to movement of one or more keyset levers.

It should be noted that since the major components may be made of molded plastic or the like and are designed to interact so as to maintain the number of components required to a minimum, the data recorder is compact in construction and relatively inexpensive to manufacture.

Although specific mechanisms and conditions are set forth in the above description, these are merely illustrative of the present invention. Other modifications and/or additions will readily occur to those skilled in the art upon reading the disclosure, and these are intended to be encompassed within the spirit of the invention.

What is claimed is:

1. A data recorder, comprising;

a bed for holding a form to be imprinted;

a platen carriage movable in a path across the bed from a start position to an actuated position to perform a printing operation and back to the start position to complete a printing cycle;

a roller platen supported transversely of the path of the platen carriage;

a plurality of rotatably positionable print wheels in the bed located for printing cooperation with the roller platen;

positioning means for each print wheel movable in a path from a zero position to one of a plurality of selected printing positions for rotating the print wheel to a desired peripheral setting;

reset means movable from an initial position to a final position for moving each of the positioning means from the selected printing position to the zero position;

first actuator means on the reset means for moving the reset means from the initial to the final position in response to movement of the platen carriage to the actuated position;

lock-out means including a locking lever movable from an inactive position to an active position for preventing subsequent movement of the platen carriage from the start to the actuated position;

first biasing means for moving the locking lever from the inactive to the active position in response to movement of the positioning means to the zero position;

second biasing means responsive to movement of the platen carriage from the actuated to the start position for moving the reset means to the initial position; and second actuator means responsive to movement of at least one of the positioning means from the zero position to a selected printing position for moving the locking lever from the active to the inactive position for permitting subsequent movement of the platen carriage through a printing cycle.

2. A data recorder as set forth in claim 1 further comprising housing means depending from the bed, said lock-out means comprising:

a locking pawl on the housing means in the path of movement of the positioning means pivotable from a second position to a first position in response to movement of the positioning means to the zero position and from the first position to the second position in response to movement of the positioning means to a selected printing position;

roller means on the platen carriage movable with the platen carriage in a path; and a blocking element on the locking lever;

said first biasing means responsive to movement of the locking pawl to the first position for moving the locking lever to the active position for positioning the blocking element in the path of the roller means to prevent movement of the platen carriage from the start position.

3. A data recorder as set forth in claim 2 in which the second actuator means is provided on the locking pawl, further comprising;

flange means on the locking lever;

said second actuator means coacting with the flange means for moving the locking lever to the inactive position and the blocking element out of the path of the roller means against the action of the first biasing means to permit movement of the platen carriage from the start position in response to movement of the locking pawl to the second position.

4. A data recorder as set forth in claim 1 further comprising a cover means for supporting the bed, the reset means comprising:

a pair of pivot means on the cover means positioned on a centerline extending parallel to the path of movement of the positioning means;

a first and a second link of equal length each pivotally mounted on one of said pair of pivot means;

a third link extending transverse and perpendicular to the path of movement of the positioning means for engaging and moving the positioning means to the zero position; and hinge means for connecting the third link to the first and the second link;

said first actuator means movably positioned in the path of movement of the platen carriage for pivoting the first and the second link and moving the third link into engagement with the positioning means for moving the positioning means to the zero position in response to the first actuator means being moved by the platen carriage in the movement of the platen carriage to the actuated position.

5. A data recorder as set forth in claim 4 in which the cover means is provided with a slot means, said first actuator means being positioned within the slot means to provide for controlled movement of the first actuator means by the platen carriage.

6. A data recorder as set forth in claim 1 further comprising:

a base including housing means depending from the bed;

detent means mounted on the housing means actuable among a first position for detenting the print wheels to permit setting of the print wheels to a selected printing position when the platen carriage is in the start position, a second position for holding the print wheels against rotation during imprinting of the form as the platen carriage is moved towards the actuated position and a third position for releasing the print wheels for rotation during movement of the positioning means to the zero position following imprinting of the form;

resilient means integral with the detent means;

cam means pivotally mounted on the base for coaction with the resilient means;

a plurality of cam profiles on the cam means; and follower means on the platen carriage coacting with the cam profiles in response to movement of the platen carriage through a printing operation for pivoting the cam means in one direction to act against the resilient means for actuating the detent means to the first and the second position, and for pivoting the cam means in an opposite direction to permit movement of the detent means to the third position.

7. A data recorder as set forth in claim 6 further comprising bail means associated with the cam means and coacting with the resilient means for actuating the detent means to the third position.

* * * * *